US006001021A

United States Patent [19]

Battaglia

[11] Patent Number: 6,001,021

[45] Date of Patent: Dec. 14, 1999

[54] SELF-SUPPORTING GARDEN SWING STRUCTURE

[75] Inventor: Francesco Battaglia, Coccaglio, Italy

[73] Assignee: Scab Giardino S.p.A., Coccaglio, Italy

[21] Appl. No.: 09/189,362

[22] Filed: Nov. 9, 1998

[30] Foreign Application Priority Data

Aug. 7, 1998 [IT] Italy ..... BS98U0062

[51] Int. Cl.[6] ..... A63G 9/12

[52] U.S. Cl. ..... 472/118; 472/125; 297/281; 248/163.2

[58] Field of Search ..... 472/118, 125, 472/119, 120; 297/273, 280, 281, 282; 5/127, 130; 248/163.2, 164, 165

[56] References Cited

U.S. PATENT DOCUMENTS

| | | | |
|---|---|---|---|
| 1,677,844 | 7/1928 | Patton | 248/163.2 |
| 3,990,667 | 11/1976 | Tomalinas, Jr. | 472/118 X |
| 4,229,845 | 10/1980 | De Cuadros | 5/127 |
| 4,456,244 | 6/1984 | Andrews | 472/124 |
| 4,807,872 | 2/1989 | Spilman et al. | 472/118 X |
| 5,016,873 | 5/1991 | Bossa | 472/118 |
| 5,564,987 | 10/1996 | Ayrolles | 472/118 |

*Primary Examiner*—Kien T. Nguyen
*Attorney, Agent, or Firm*—McGlew AND Tuttle, P.C.

[57] ABSTRACT

A self-supporting swing structure made of a plastic material is disclosed. The swing includes two support shoulders (11), a horizontal crosspiece (12) for connecting the support shoulders in their upper part, and an oscillating seat (13) hung from suspension supports (14), which are fixed to the crosspiece. Each support shoulder (11) includes two tubular legs (15), which are fixed to one another at the top and to an end of the said crosspiece (12) by a locking bolt (16). The two legs turn downward and are joined at half height by at least one connecting crossbar (17). This connecting crossbar has its ends threaded in tubular joints (15') of the legs, and they are locked there by anti-unthreading tongues (17') and pins (20). In addition, the legs (15) of each shoulder (11) are rigidly connected (32, 114, 131) to an adjacent suspension support (14) of the oscillating seat.

13 Claims, 8 Drawing Sheets

SELF-SUPPORTING GARDEN SWING STRUCTURE

FIELD OF THE INVENTION

The present invention pertains to self-supporting swings or seesaws made of plastic material.

BACKGROUND OF THE INVENTION

Different embodiments of garden swings or seesaws made of plastic material are already known, in which, however and invariably, each shoulder is en bloc, i.e., is molded in a single piece of large dimensions. The shoulders produced in this manner, given their space occupied and not being able to be disassembled, place remarkable problems in the way of packing and of shipping and, when assembled, they require particular measures and means for the stability of the structure of the swing.

SUMMARY AND OBJECTS OF THE INVENTION

Therefore, the object of the present invention is to create a garden swing made of plastic material which has been changed to improve its complex structure and to increase its stability and use safety, thanks to a particular shaping and combination of its components, especially of the shoulders, which are made into more rigid component parts, and in the connection of these shoulders to a crosspiece holding the oscillating seat.

According to the invention, a self-supporting swing structure made of a plastic material is provided including two support shoulders. A horizontal crosspiece for connecting the support shoulders in their upper part and an oscillating seat hung from the suspension supports that are fixed to the crosspiece are also provided. The support shoulder is formed by two tubular legs, which are fixed at the top to one another and to one end of the crosspiece by means of a locking bolt which turn downward and which are joined at half height by at least one connecting crossbar. The connecting crossbar has its ends threaded in tubular joints of legs and is locked there by means of the anti-unthreading tongues and pins. Legs of each of the shoulders are rigidly connected to an adjacent suspension support for the oscillating seat fixed to the crosspiece.

Thus, and advantageously, when the components of the swing are separated, they are able to be packed and shipped under conditions of overall minimum space occupied and reduced costs. Actually, thanks to the ability of the shoulders to be disassembled, the packing of the swing of such reduced dimensions results in its being able to be loaded and shipped on a motor vehicle.

Once it has arrived at its destination, the swing may then be reassembled with ease, without providing special tools, and with the simplicity of handling all the components.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
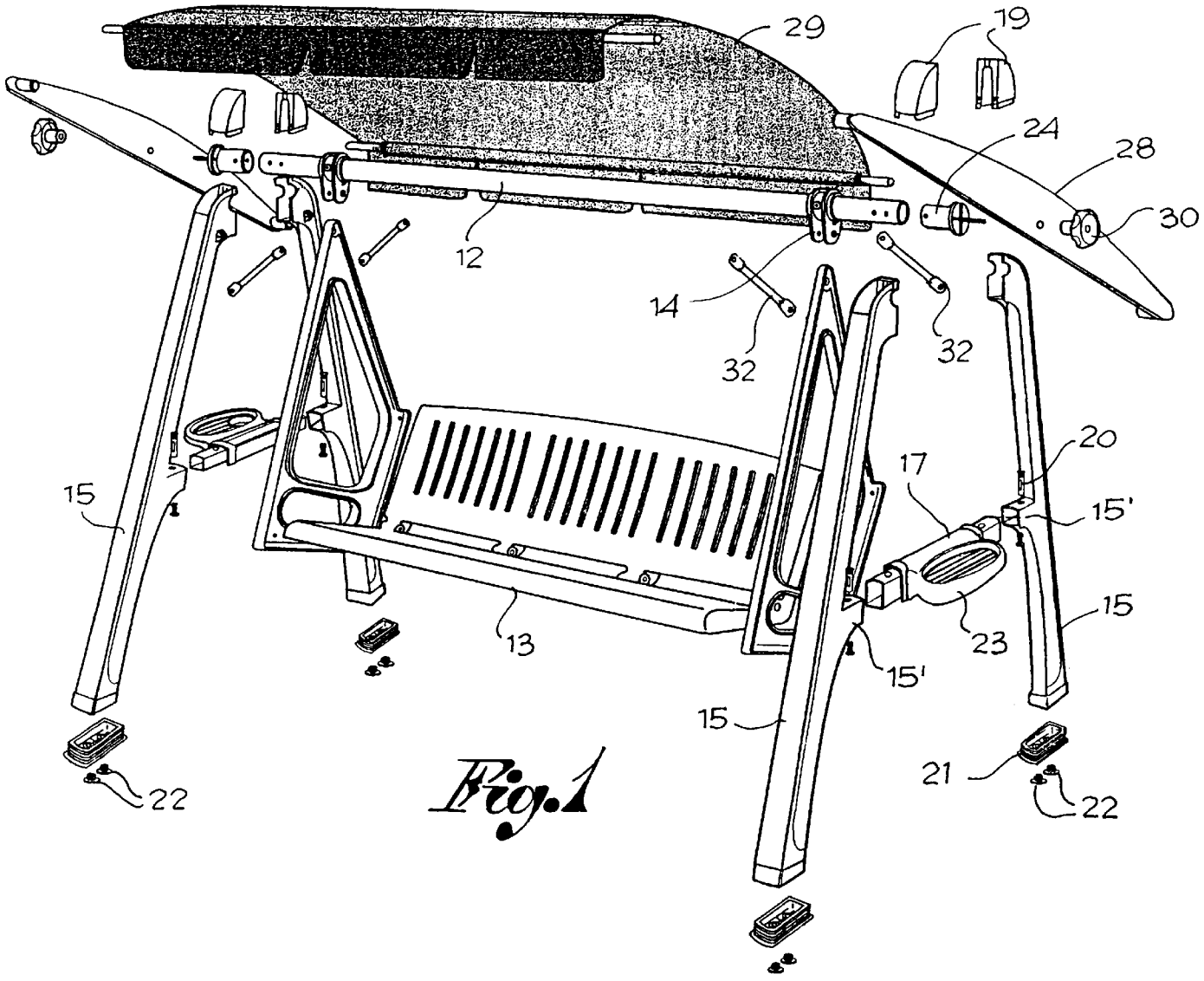
FIG. 1 is a perspective vies of the components of the swing which are shown in an "exploded" view.

Referring to the drawings in particular, the self-supporting swing illustrated comprises two support shoulders 11, a horizontal crosspiece 12 connecting the shoulders 11 at the top, as well as an oscillating seat 13 hung from two suspension supports 14, which are fixed to the said crosspiece.

As a whole, each support shoulder 11 has the shape of an "A." It consists of two tubular legs 15, diverging from top to bottom, which are joined and fixed in their upper part to one another and to the horizontal crosspiece 12 by means of a locking bolt 16, and are connected at half their height, with at least one crossbar 17.

Figure 6:
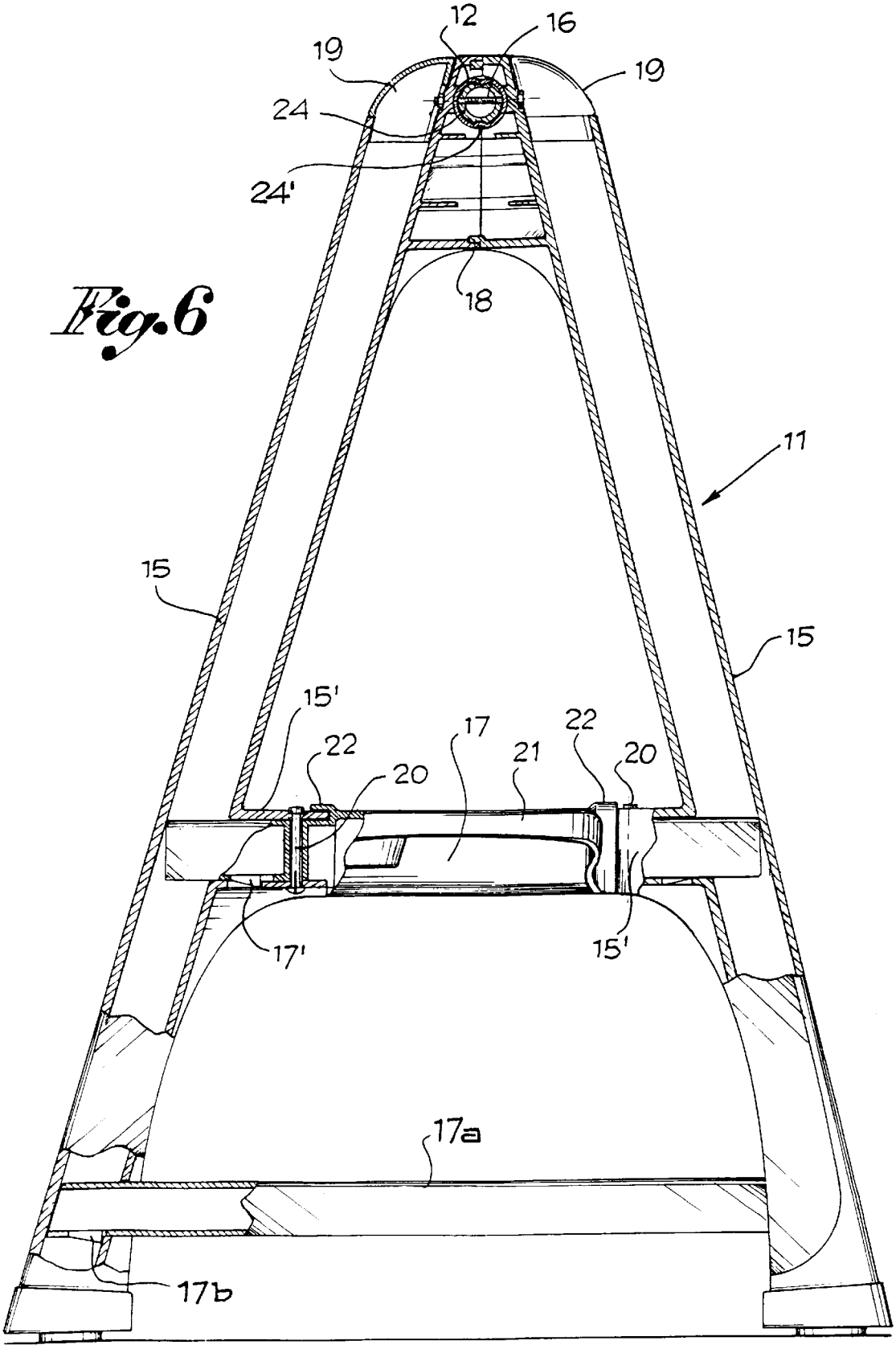
FIG. 6 is a partial vertical section of an assembled shoulder.
Figure 7:
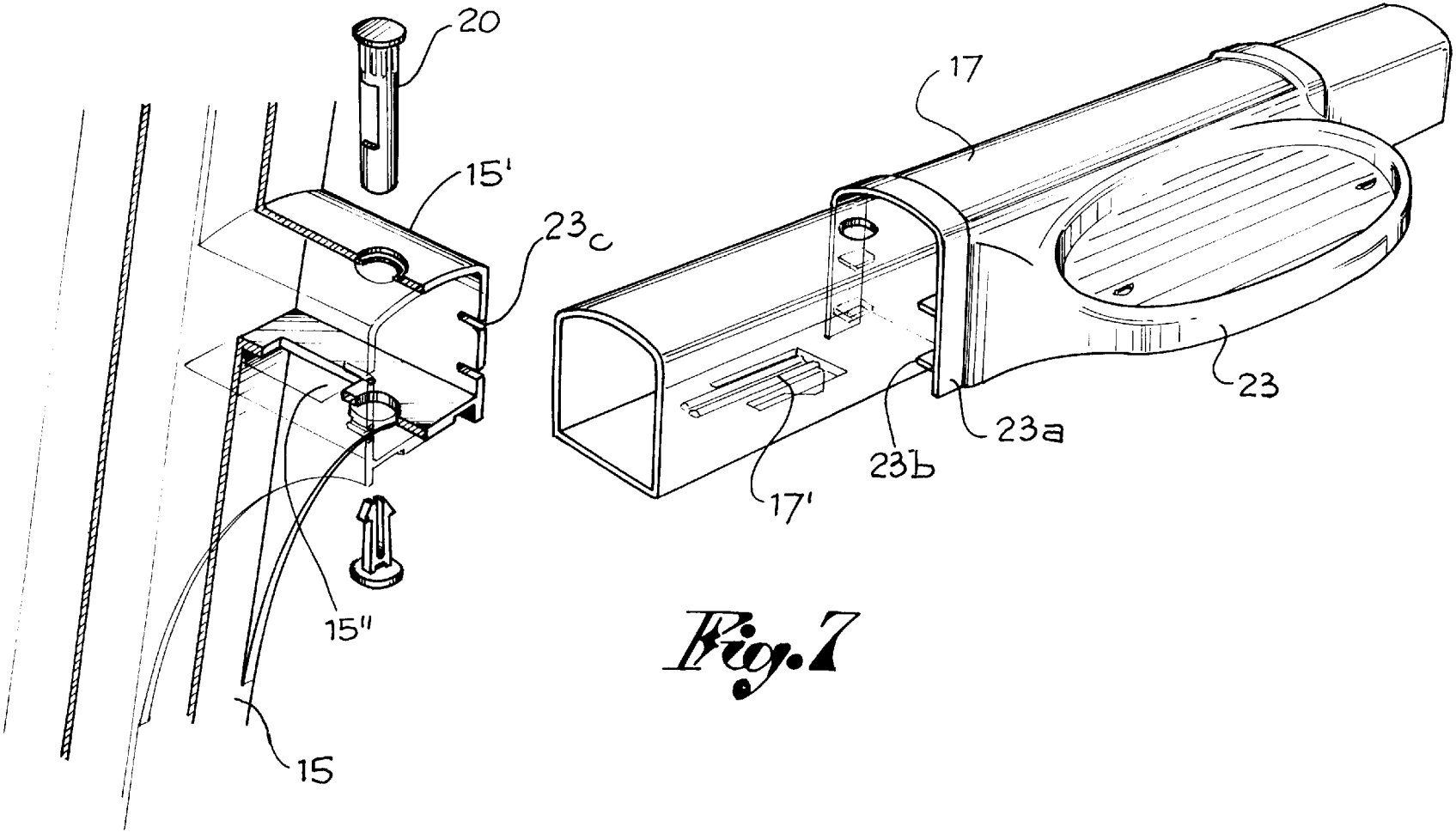
FIG. 7 is a partial perspective view of a leg and a crossbar of a shoulder, which are separated.

For the joining at the top, one leg of each shoulder (see FIG. 6) has a centering projection 18, which is joined with a recess on the opposite leg.

On the surfaces fitting together, the legs 15 of each shoulder 11 have two circular notches 15a that together form a seat for one end of the crosspiece 12.

The locking bolt 16 is arranged in the cavities 15*b*, which are provided at the top of the legs and, at the same time, joins the legs to one another and to the crosspiece 12, the cavities then being covered by pressure-mounted caps 19.

For the connecting at half height, each of the legs 15 has a tubular joint 15' which is intended to receive an end of the connecting crossbar 17. Each end of this crossbar 17 has an anti-unthreading elastic tooth 17', which is intended to snap into a slot 15" of the tubular joint 15', in which it is to be fit. For further safety, each end of the connecting crossbar 17 is then connected to the corresponding joint 15' by means of a pin 20.

At the lower end, each tubular leg 15 is provided with an end molding 21, which is in turn provided with one or two support feet 22.

On the other hand, the connecting crossbar 17 of the legs, which form each shoulder 11, may also be provided with an object-holding tray 23 with or without glass-and/or bottle-holding depressions, as well as outer collars 23*a* which are superimposed party by the joints 15', which cover the joint lines between joints 15' and crossbars. In addition, inside each collar are provided the ribs or fins 23*b* which are inserted in slots 23*c* provided at the ends of the said joints 15', which contributes to the further improvement of the rigidity of the joining. The legs of each shoulder may also be connected to one another, if necessary for purposes of far greater stability, by a second crossbar 17*a* with its ends passing through and snapping, by means of the teeth 17*b*, in openings provided in the said legs.

The support shoulders 11 are connected to the upper horizontal crosspiece 12 by placing couplings 24 between them. These couplings 24 are threaded in the ends of the crosspiece 12 in a direction defined by the reference means 24' and are fixed there with the same bolts 16, which lock the tops of the legs and the crosspiece.

Figure 8:
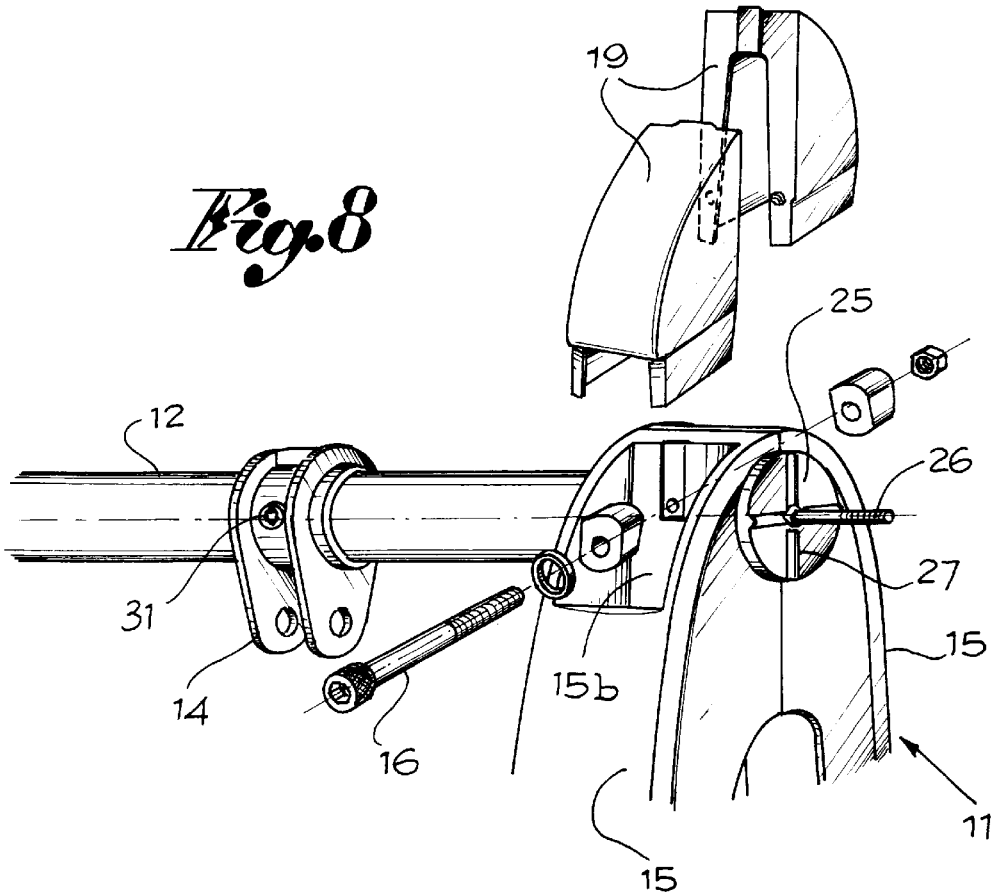
FIG. 8 is the means for fixing the shoulder with the connecting crosspiece.
Figure 9:
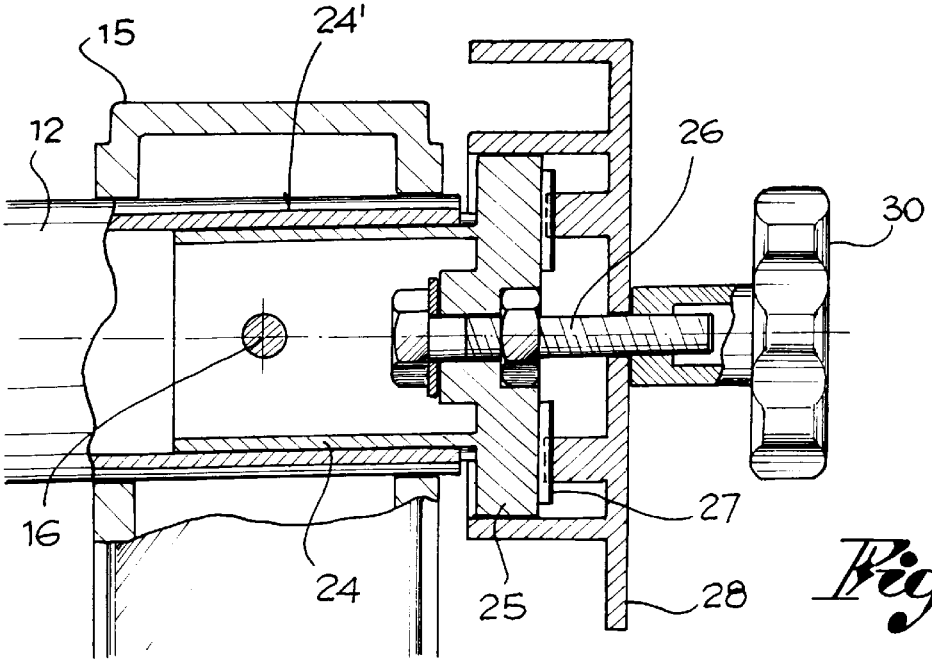
FIG. 9 is the connection of a sunshade support to an end of the upper crosspiece.

Moreover, each coupling 24 has a head flange 25, which has a central bolt 26 and has a front toothing 27 (cf. FIG. 8). The supports 28 of a sunshade covering 29, which may be adjusted, thanks to the front toothing, and be locked in the desired positions by means of a locking knob 30 screwed onto the central bolt 26 of each coupling, are joined to the flanges 25 of the couplings 24.

Figure 3:
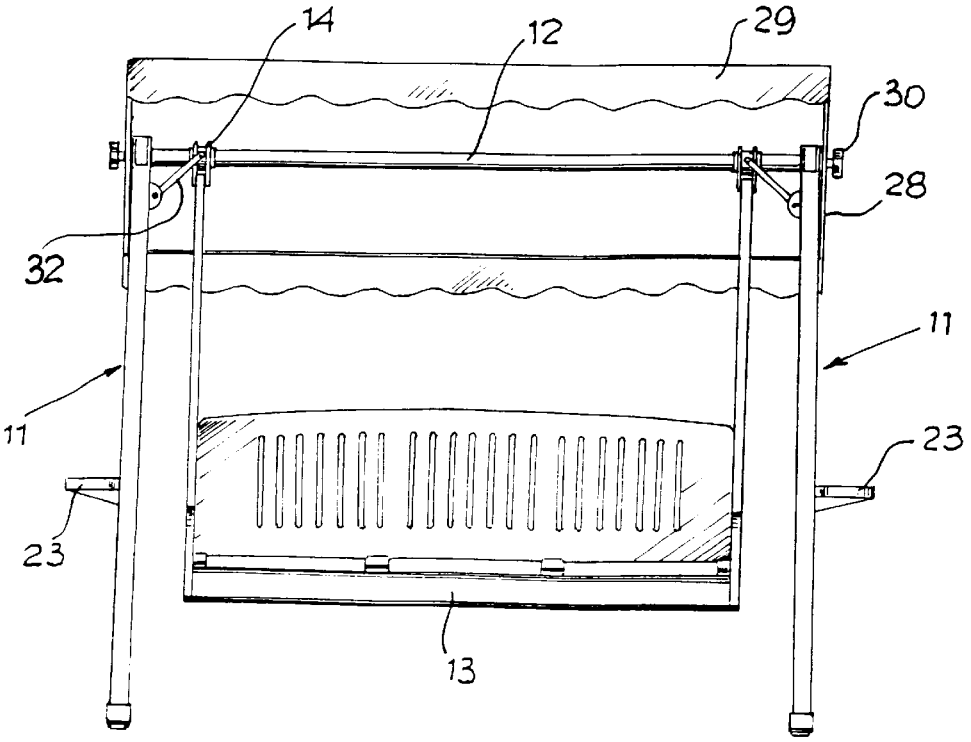
FIG. 3 is a front view thereof, but without cross rods.
Figure 4:
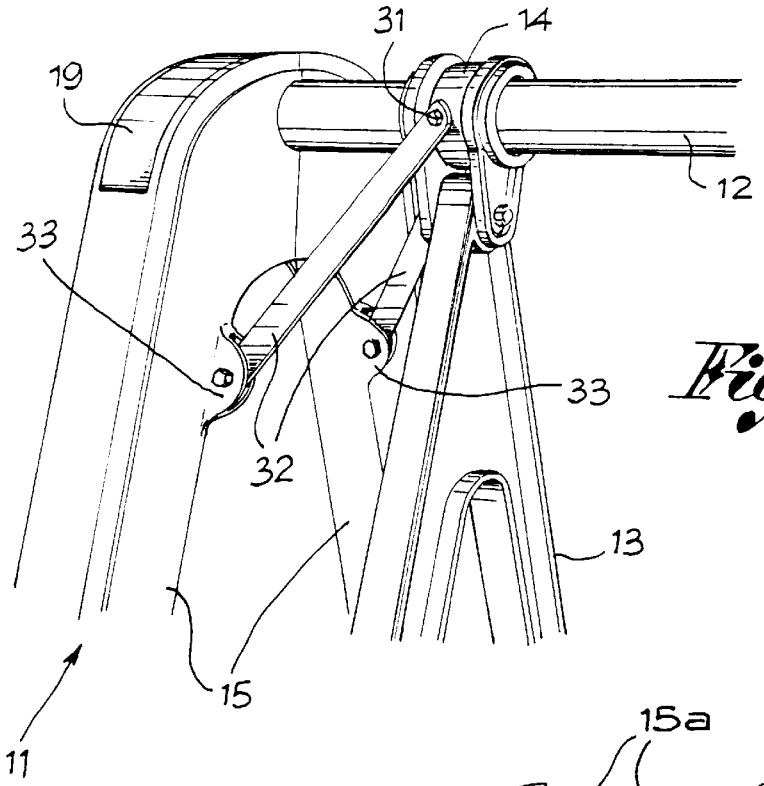
FIG. 4 is an enlarged detail corresponding to the part circled in FIG. 2.
Figure 5:
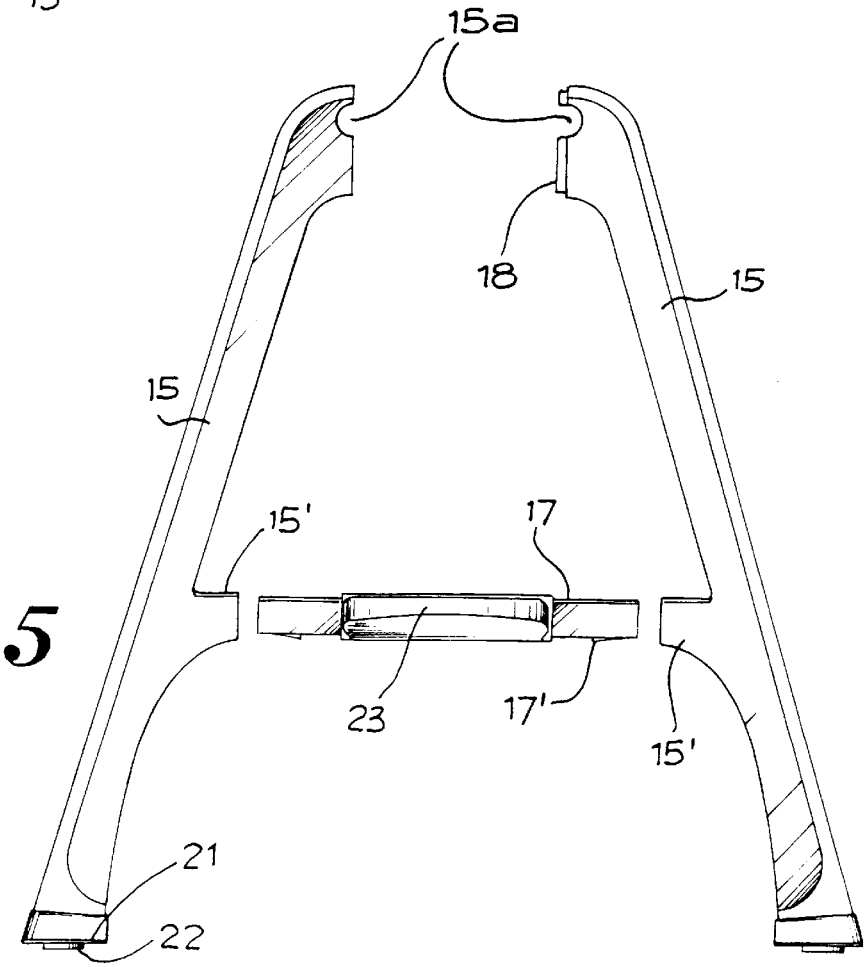
FIG. 5 is a side view of the disassembled elements of a support shoulder.

Each support 14, from which the oscillating seat 13 is hung, is fixed to the upper crosspiece 12 by means of a horizontally arranged cross pin 31. This pin 31 protrudes from both sides of the support 14, and to this cross pin 31 are connected the ends of two rigid rods or braces 32, whose opposite ends are then connected to lugs 33, which are made in one piece with the legs 15 that form the support shoulder adjacent to the support. The said rods are inclined at ca. 45° in relation to the crosspiece (cf. FIGS. 3 and 4) and make it possible to give the structure proper stability against twisting and bending when it is stressed by use.

Figure 10:
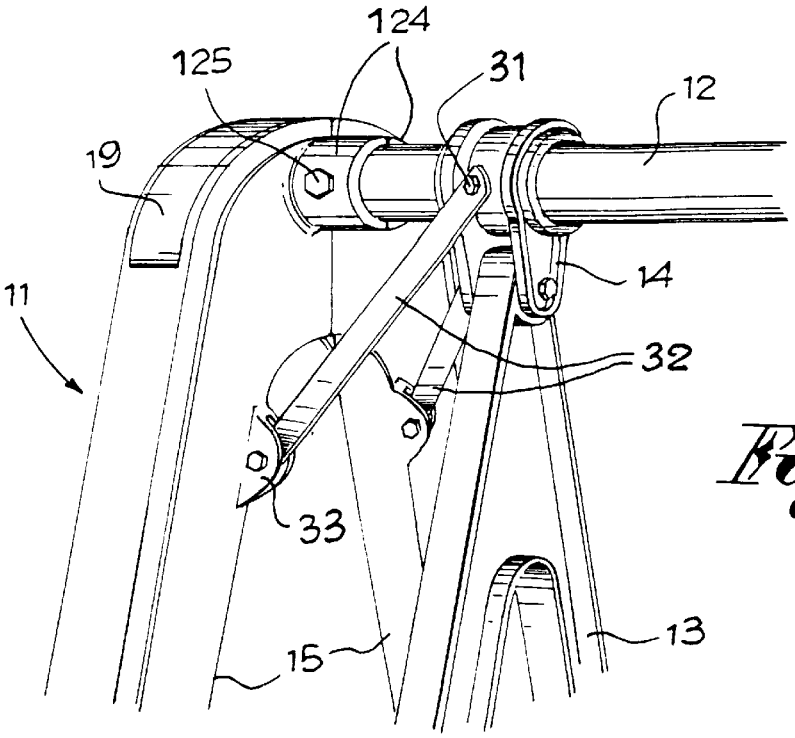
FIG. 10 is a perspective view of the connection of one of the shoulders to the horizontal upper crosspiece according to a design variant with respect to FIG. 4.
Figure 11:
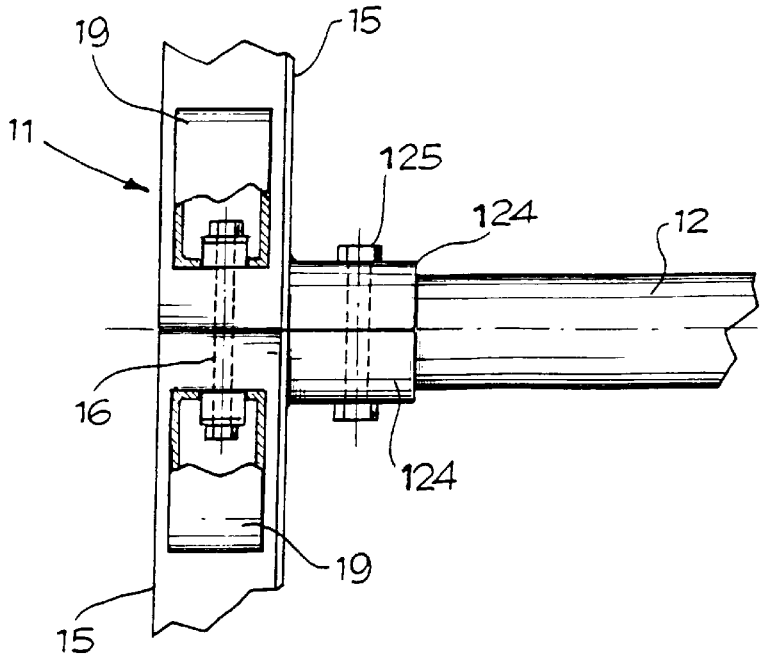
FIG. 11 is a top view of the connection of FIG. 10, in partial section.

In a particular embodiment, the connecting of the support shoulders 11 at the ends of the upper crosspiece 12, besides with the locking bolts 16, may also be carried out by means of two semicylindrical shells 124, which are made in one piece with the legs 15 of each shoulder and which, together, form, with the said shoulder assembled, a coupling that encloses the crosspiece 12 and that is fixed to same by means of another cross bolt (FIGS. 10 and 11).

Figure 12:
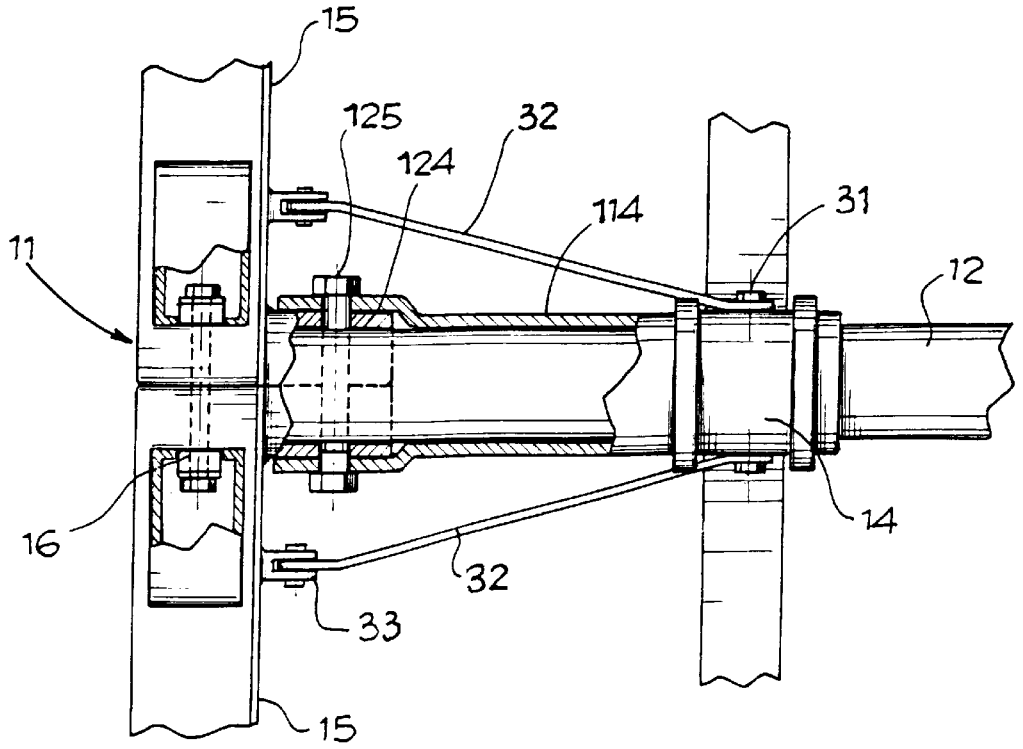
FIG. 12 is a top view of another variant in the connection of one of the shoulders to the upper crosspiece in partial section.

In a design variant, as is shown in FIG. 12, each suspension support 14, without prejudice to its fixation to the crosspiece 12 by means of the cross pin 31 and to the shoulder by means of the rods 32, may be provided with a tubular extension 114, which is superimposed by the semicylindrical shells 124 that are made in one piece with the legs 15 and which is fixed with these by means of the cross bolt 125. This measure also contributes to the solidity of the structure.

Figure 13:
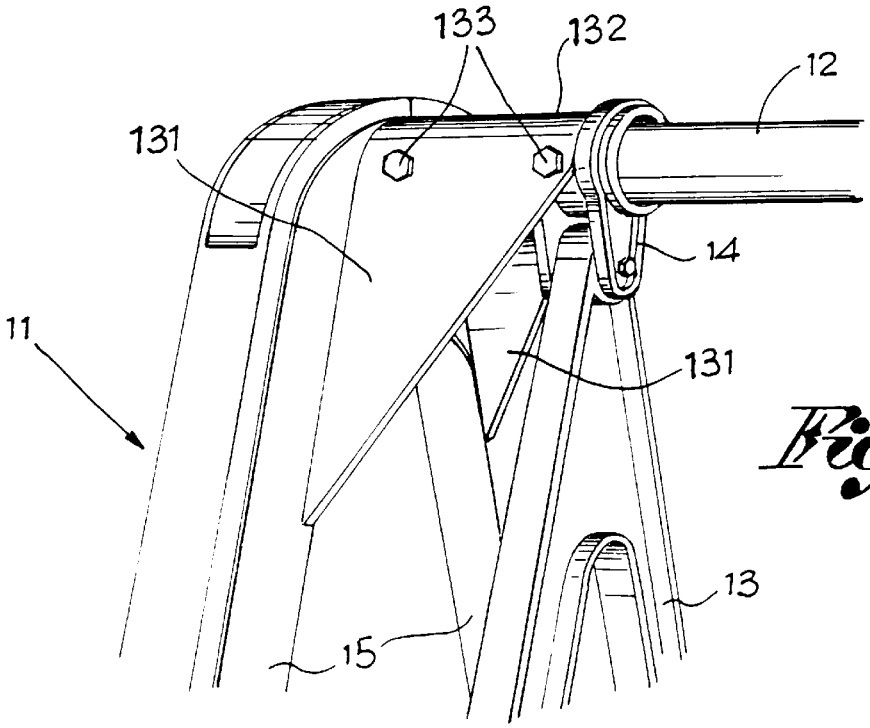
FIG. 13 is a perspective view of another manner of connecting one of the shoulders to the upper crosspiece.

In another embodiment as is shown in FIG. 13, the rods 32 are eliminated and the crosspiece 12 is joined to each support shoulder by means of connection plates 131 which are made in one piece with the legs 15 forming the shoulder and which end with C-shaped portions 132 that enclose the crosspiece 12 and possibly also the adjacent suspension support 14. The connection plates 131 are fixed to one another, to the crosspiece and to the suspension support, at least by means of a pair of bolts 133, ensuring the required rigidity.

Figure 2:
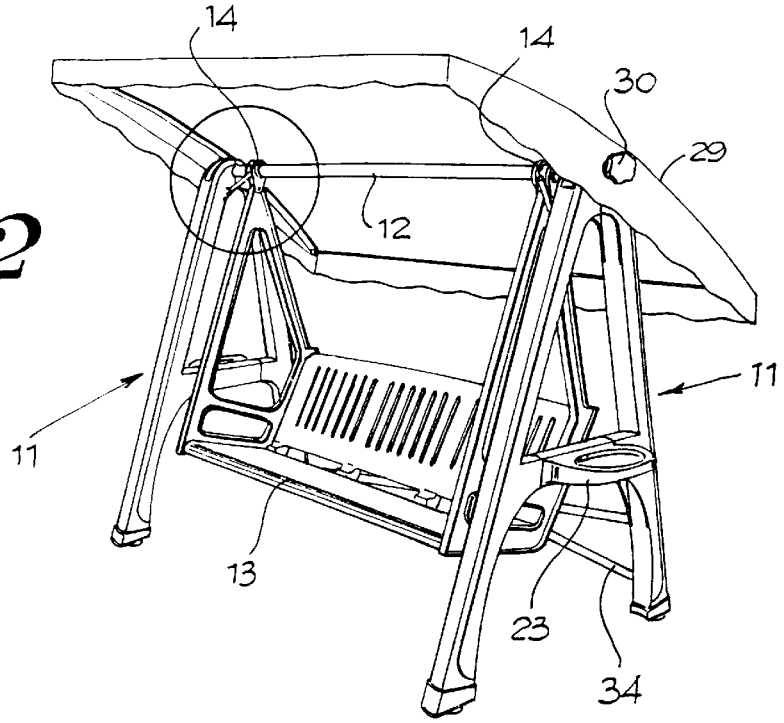
FIG. 2 is a perspective view of the assembled swing with cross rods in the rear connecting the shoulders.

Finally, it should be noted that the rear legs of the swing structure may be connected by at least one, but preferably two, stiffening rods 34 as is shown in FIG. 2, a solution which may make it possible to eliminate either the rods or braces, or the connection plates on top.

While specific embodiments of the invention have been shown and described in detail to illustrate the application of the principles of the invention, it will be understood that the invention may be embodied otherwise without departing from such principles.

What is claimed is:

1. A self-supporting swing structure made of a plastic material, the structure comprising:

two support shoulders;

a horizontal crosspiece for connecting the support shoulders in their upper part;

suspension supports fixed to said crosspiece;

an oscillaiting seat hung from said suspension supports, each of said support shoulders being formed by two tubular legs, anti-unthreading tongues, pins, a locking bolt and a connecting crossbar, said tubular legs being fixed at a top to one another and to one end of said crosspiece by said locking bolt, said tubular legs turning downward from said top and being joined at half height by said connecting crossbar, said connecting crossbar having ends threaded in tubular joints of said legs and locked there by said anti-unthreading tongues and said pins, said legs of each of said shoulders being rigidly connected to an adjacent one of said suspension supports.

2. The swing structure in accordance with claim 1, wherein each of said suspension supports of said oscillating seat that is fixed to said crosspiece is connected to said adjacent support shoulder by one of rigid rods or braces.

3. The swing structure in accordance with claim 2, wherein each of said suspension supports is fixed to said crosspiece by a horizontal cross pin and said rigid rods or braces are attached to said pin and to corresponding lugs made in one piece with said support shoulder.

4. The swing structure in accordance with claim 2, wherein said rods or braces are inclined at substantially 45° in relation to said crosspiece.

5. The swing structure in accordance with claim 1, wherein said legs of each said shoulder have two opposite semicylindrical shells, which form, with said shoulder assembled, a connection coupling enclosing said crosspiece being fixed to same by a cross bolt.

6. The swing structure in accordance with claim 5, wherein each of said suspension supports is made in one piece with a tubular extension superimposed by and fixed to said shells, said shells forming a connection coupling between said shoulder and said crosspiece.

7. The swing structure in accordance with claim 1, wherein said legs of each said shoulder have two connection plates made in one piece with same and ending with C-shaped portions one in front of the other, said C-shaped portions enclosing said crosspiece and being fixed to said crosspiece by bolts.

8. The swing structure in accordance with claim 7, wherein said C-shaped portions enclose said crosspiece and said adjacent suspension support of said oscillating seat and being fixed to the said support by said bolts.

9. The swing structure in accordance with claim 1, wherein said bolt for locking said legs to one another and to said upper crosspiece is arranged in a cavity provided at said top of said legs and is covered with a pressure-mounted caps.

10. The swing structure in accordance with claim 1, wherein said crossbar for connecting said legs of each said shoulder has two collars on the outside, which are partly superimposed by said joints, in which the ends of said crossbar are accommodated and held.

11. The swing structure in accordance with claim 1, wherein said legs of each said shoulder are connected to one another by a snap-mounted second crossbar.

12. The swing structure in accordance with claim 1, wherein said rear legs of said shoulders are connected to one another by one or two stiffening rods.

13. The swing structure in accordance with claim 1, wherein said crosspiece is arranged horizontally and ends of said crosspiece are fixed by joint couplings supporting a sunshade covering, and an adjusting and locking device is provide for adjusting and locking said covering in various positions, each said coupling being fixed to said horizontal crosspiece with said locking bolt for joining the said legs of each said support shoulder.

* * * * *